US009783871B2

(12) United States Patent
Brandt et al.

(10) Patent No.: US 9,783,871 B2
(45) Date of Patent: Oct. 10, 2017

(54) METHOD OF PRODUCING ALUMINIUM ALLOYS CONTAINING LITHIUM

(71) Applicant: ALERIS ROLLED PRODUCTS GERMANY GMBH, Koblenz (DE)

(72) Inventors: Fred Brandt, Neuwied (DE); Philippe Meyer, Koblenz (DE)

(73) Assignee: ALERIS ROLLED PRODUCTS GERMANY GMBH, Koblenz (DE)

( * ) Notice: Subject to any disclaimer, the term of this patent is extended or adjusted under 35 U.S.C. 154(b) by 0 days.

(21) Appl. No.: 14/901,253

(22) PCT Filed: Jun. 27, 2014

(86) PCT No.: PCT/EP2014/063751

§ 371 (c)(1),
(2) Date: Dec. 28, 2015

(87) PCT Pub. No.: WO2015/003934

PCT Pub. Date: Jan. 15, 2015

(65) Prior Publication Data

US 2016/0160320 A1 Jun. 9, 2016

(30) Foreign Application Priority Data

Jul. 11, 2013 (EP) ..... 13176175

(51) Int. Cl.

| | |
|---|---|
| ***B22D 1/00*** | (2006.01) |
| ***B22D 7/00*** | (2006.01) |
| ***B22D 11/00*** | (2006.01) |
| ***B22D 11/10*** | (2006.01) |
| ***B22D 21/04*** | (2006.01) |
| ***C22C 1/02*** | (2006.01) |
| ***C22B 21/04*** | (2006.01) |
| ***C22C 21/00*** | (2006.01) |

(52) U.S. Cl.

CPC ..... *C22C 1/026* (2013.01); *B22D 1/00* (2013.01); *B22D 11/003* (2013.01); *C22B 21/04* (2013.01); *C22C 21/00* (2013.01)

(58) Field of Classification Search

CPC . B22D 1/00; B22D 7/005; B22D 7/02; B22D 21/007; B22D 21/04; B22D 11/003; B22D 11/041; B22D 11/086; B22D 11/10; B22D 11/119; B22D 37/00

USPC ... 164/55.1, 57.1, 94, 95, 96, 460, 471, 473, 164/475, 487

See application file for complete search history.

(56) References Cited

U.S. PATENT DOCUMENTS

| | | | | |
|---|---|---|---|---|
| 4,248,630 | A | 2/1981 | Balmuth | |
| 4,556,535 | A | 12/1985 | Bowman et al. | |
| 4,582,118 | A | 4/1986 | Jacoby et al. | |
| 4,761,266 | A | 8/1988 | Bruski | |
| 4,767,598 | A | 8/1988 | Kinosz et al. | |
| 5,082,044 | A | 1/1992 | Christensen | |
| 5,415,220 | A | 5/1995 | Edwards | |
| 6,551,424 | B1 * | 4/2003 | Haszler et al. | C22F 1/047 148/552 |
| 2009/0226340 | A1 * | 9/2009 | Marya | C22C 1/0416 419/32 |
| 2011/0036534 | A1 | 2/2011 | Yeh et al. | |
| 2012/0291925 | A1 * | 11/2012 | Bes et al. | C22C 21/06 148/552 |
| 2016/0160318 | A1 | 6/2016 | Brandt et al. | |

FOREIGN PATENT DOCUMENTS

| | | | |
|---|---|---|---|
| WO | 9421405 | A1 | 9/1994 |
| WO | 2015003940 | A1 | 1/2015 |

OTHER PUBLICATIONS

International Search Report and the Written Opinion dated Sep. 3, 2014 for International Patent Application No. PCT/EP2014/063751 to Aleris Rolled Products Germany GMBH having an International filing date of Jun. 27, 2014.

Chakravorty C R et al: "Melting and Casting Characteristics of Aluminium—Lithium Alloys", Proceedings IEEE Workshop on Interactive Voice Technology Fortelecommunications Applications, Jan. 1, 1990 XX, XX, vol. 2, No. 4, Jan. 1, 1990, pp. 182-191, XP000579349.

Master Alloys—Our spice rack for the metal industry, KBM AFFILIPS Master Alloys, URL: < https://www.kbmaffilips.com/what-is-a-master-alloy/ >, retrieved from the Internet Mar. 15, 2017.

* cited by examiner

*Primary Examiner* — Kevin P Kerns

(74) *Attorney, Agent, or Firm* — Vorys, Sater, Seymour and Pease LLP

(57) ABSTRACT

A method of producing molten aluminum-lithium alloys for casting a feedstock in the form of an ingot, the method including the steps of:

preparing a molten first aluminum alloy with a composition A which is free from lithium as purposive alloying element, transferring the first aluminum alloy to an induction melting furnace, adding lithium to the first aluminum alloy in the induction melting furnace to obtain a molten second aluminum alloy with a composition B having lithium as purposive alloying element, optionally adding further alloying elements to the second aluminum alloy, transferring the second alloy via a metal conveying trough from the induction melting furnace to a casting station.

14 Claims, No Drawings

METHOD OF PRODUCING ALUMINIUM ALLOYS CONTAINING LITHIUM

CROSS-REFERENCE TO RELATED APPLICATIONS

This is a §371 National Stage Application of International Application No. PCT/EP2014/063751 filed on Jun. 27, 2014, claiming the priority of European Patent Application No. 13176175.1 filed on Jul. 11, 2013.

FIELD OF THE INVENTION

The invention relates to the production of aluminium-lithium alloys. In particular, this invention relates to methods of producing molten aluminium-lithium alloys for casting into ingot or billet feedstock suitable for further processing by means of extrusion, forging and/or rolling.

BACKGROUND TO THE INVENTION

As will be appreciated herein below, except as otherwise indicated, aluminium alloy designations refer to the Aluminium Association designations in Aluminium Standards and Data and the Registration Records, as published by the Aluminium Association in 2013 and are well known to the person skilled in the art.

For any description of aluminium alloy compositions or preferred aluminium alloy compositions, all references to percentages are by weight percent unless otherwise indicated.

Aluminium alloys comprising lithium are very beneficial for use in the aerospace industry since the purposive addition of lithium may reduce the density of the aluminium alloy by about 3% and increase the modulus of elasticity by about 6% for each weight percent of lithium added. In order for these alloys to be selected in airplanes, their performance with respect to other engineering properties must be as good as that of commonly used alloys, in particular in terms of the compromise between the static mechanical strength properties and the damage tolerance properties. Over time a wide range of aluminium-lithium alloys have been developed with a corresponding wide range of thermo-mechanical processing routes. However, a key processing route remains the casting of ingots or billets for further processing by means of extrusion, forging and/or rolling. The casting process has proven to remain a problematic processing step in the industrial scale production of ingots and billets. There are, for example, issues with regard to oxidation of molten metal in the furnaces, the transfer troughs and during casting itself.

U.S. Pat. No. 4,761,266 (assigned to Kaiser Aluminum) discloses a method for preparing an aluminium-lithium alloy at a preselected ratio of aluminium to lithium. The method comprises preparing an amount of molten lithium and an amount of molten aluminium melt. The molten lithium is filtered using stainless steel filters to remove solids from the molten lithium, notably lithium oxides and hydroxides. The molten aluminium melt is melt treated by degassing prior to mixing with the molten lithium. The molten lithium and molten aluminium are mixed in a complex apparatus incorporating a vortex bowl. The swirling action of the vortex causes mixing of the aluminium and lithium, which then proceeds as a homogeneous mixture downward through an exit passage at the base of a funnel. The mixture enters a degassing chamber, where the mixture is purged with argon. The purged mixture is then passed through a filter to remove any oxides and refractory fragments which may have entered the system. The molten mixture then enters an ingot casting station. All components of the system are blanketed in an inert atmosphere. This method has various disadvantages. For example, there is a sensitivity for viscosity of the alloy and thus for fluctuations in the temperature of the metal in the vortex bowl. Although the system is blanketed in an inert atmosphere, there will be a high risk of entrapment of gas and oxides in the molten metal, which have to be removed subsequently. The alloying system is a complex and dynamic system whereby small variations in metal flow may lead to undesirable changes in alloy composition in the final ingot.

DESCRIPTION OF THE INVENTION

It is an object of the invention to provide a method of producing molten aluminium-lithium alloy feedstock which is more reliable and less sensitive to small fluctuations in metal flow, or at least to provide an alternative method of producing molten aluminium-lithium alloys.

This and other objects and further advantages are met or exceeded by the present invention and providing a method of producing molten aluminium-lithium alloys for casting a feedstock in the form of an ingot suitable for further processing by means of extrusion, forging and/or rolling, the method comprising the steps of:

(a) preparing a molten first aluminium alloy with a composition A which is free from lithium as purposive alloying element, preferably the molten aluminium alloy is also melt treated by means of degassing and preferably also by means of filtering, e.g. by using a ceramic foam filter;

(b) transferring the first aluminium alloy to an induction melting furnace, preferably without creating any turbulence in the molten aluminium so as to avoid entrapment of newly created oxides due to the turbulence or pick-up of refractory fragments;

(c) adding lithium to the first aluminium alloy in the induction melting furnace to obtain a molten second aluminium alloy with a composition B having lithium as purposive alloying element, (d) optionally adding further alloying elements to the second aluminium alloy, (e) transferring the second alloy (with optional further alloying elements) via a metal conveying trough from the induction melting furnace to a casting station, and preferably without creating any turbulence in the molten aluminium to avoid the formation of any oxides in molten aluminium.

In accordance with the present invention it has been found that an induction melting furnace allows for the batch wise production of large volumes (several tonnes, e.g. 3 to 10 tonnes or more) of aluminium-lithium alloy leading to a reproducible and consistent alloy composition for the subsequent casting of an ingot. In an induction furnace the molten metal is kept in motion by means of one of more inductors. The fluid flow in the molten bath can be tailored such that the surface of the molten aluminium is kept stable and substantially free from turbulence or vortexes, thereby significantly reducing the pick-up of gas, e.g. hydrogen, nitrogen, oxygen or humidity, or entrapment of oxides. Also the maintaining of an inert gas atmosphere above the molten aluminium can be obtained easily compared to for example a gas fired melting furnace. Due to the controllable fluid flow induced by the inductor(s) the introduction of alloying elements, and lithium in particular, is very fast and a very good homogeneity of the melt can be obtained. Yet a further advantage of an induction melting furnace is that after transfer of the first aluminium alloy to the furnace, it can be used to remelt thick gauge scrap material, including Li-containing scrap material. Thin gauge scrap material like turnings are to be avoided due to excessive dross formation at the surface of the molten metal.

During step (d) the molten aluminium alloy can be tailored to its required final composition. For example minor amounts of alloying elements can be added should the alloy composition not already be at its target composition. Also relatively expensive alloying elements like silver can be added at a late stage to minimise any scrap having such precious alloying elements or to avoid or at least reduce any possible settlement of heavy alloying elements in the furnace.

Where in the context of this invention reference is made to an ingot, it will be understood by the skilled person that this relates both to a rolling ingot having a length L and commonly forming the rolling direction, a width W and a thickness T, as well as to billet that can be used for extrusion or forging and having a length L, commonly forming the direction of extrusion, and having a substantially round periphery such that the width and thickness are the same dimension forming the diameter of the billet. As well known in the art, an extrusion billet may also have an ellipse shape.

The present invention applies to various casting processes and preferably to a casting process chosen from direct chill casting, horizontal casting, continuous casting of strips between cylinders, and continuous casting of strips using a belt caster.

The process known to one skilled in the art as "direct chill casting" or "DC casting" is a preferred process within the context of this invention. In such a process, an aluminium alloy is cast in a water-cooled ingot mould with a dummy bottom or starter block while moving the dummy bottom vertically and continuously so as to maintain a substantially constant level of molten metal in the mould during solidification of the alloy, the solidified faces being directly cooled with a cooling medium, e.g. water, glycol or a combination thereof. The vertical casting direction forms the length direction of the subsequent cast ingot.

In an alternative embodiment there is provided a method of melting and casting an ingot of an aluminium alloy comprising lithium, the ingot having a length L direction, width W, and thickness T, the method comprising the steps of:

(i) preparing at least two molten aluminium alloys in separate furnaces, viz. a third alloy with a composition C which is free from lithium as purposive alloying element, and in an induction melting furnace the second alloy with a composition B which comprises lithium as purposive alloying element;

(ii) transferring the third alloy via a metal conveying trough from the furnace to a casting station;

(iii) initiate the start of casting an ingot and casting the third alloy to a required length L1 of an ingot in the casting direction;

(iv) subsequently transferring the second alloy via a metal conveying trough from the induction melting furnace to the casting station while simultaneously stopping the transfer of the third alloy to said casting station, and whereby preferably a transition between alloys C and B is obtained with no interruption to molten metal flow;

(v) casting the second alloy from an end surface of the cast third alloy at length L1 to an additional required length L2 in the casting direction; and (vi) cropping, e.g. by means of sawing in case of a thick gauge ingot or by shearing, the cast ingot at a bottom thereof at a length that is greater than of equal to the cast length L1.

In accordance with this embodiment a casting process is being initiated with an aluminium alloy free from lithium as purposive alloying element and once a stable casting condition or casting situation has been obtained, the casting process is continued by transferring to the lithium containing aluminium alloy B. This achieves the effect that the start of the casting process is without a lithium containing alloy and avoids the disadvantages associated with that. For example, otherwise if directly starting with the lithium containing alloy, prior to the start of the casting process the mould and the starter block are commonly coated, e.g. by means of spraying, with a salt flux, which are very hygroscopic. If not properly dried in advance, moisture originating from the salt may react with the molten aluminium-lithium alloy upon pouring into the casting mould and creating highly unsafe environment. At the start of the cast the molten aluminium poured onto the starter block shrinks at solidification, which may lead to water vapour used for cooling the casting mould entering the area in the mould potentially leading to explosions when in contact with the molten aluminium-lithium alloy. Furthermore, due to a higher viscosity aluminium-lithium alloys may give raise to problems at the beginning with the metal distribution system in the casting mould, e.g. made from fibreglass fabric line for example combo-bags, and as a consequence to an uneven metal distribution these alloys are prone to have bleed-outs at the start of the casting process. Bleed-outs in case of aluminium-lithium alloys may have catastrophic effects when the molten aluminium comes into contact with cooling water. All these disadvantages and risks are overcome or at least significantly reduced in the method according to this embodiment as there is neither molten Al—Li alloy nor a need to any use of salts to reduce the oxidation by ambient oxygen at the start of the casting process. At the end of the casting process once the ingot has been solidified, the cast ingot is removed from the casting station, and thereafter the bottom of the ingot is being cropped from the ingot. Depending on the alloys cast this can be done after the cast or firstly after a heat treatment, and which could also be a homogenization heat treatment, to stress relieve the cast ingot. Although not desirable, but it is possible that in the transition from alloy A to alloy B a transition zone Z is formed having a composition intermediate between the first and second alloy. Ideally also this transition zone Z should be cropped from the cast ingot. This embodiment aims at starting or initiating the casting process, in particular the DC casting process, using a lithium free alloy. Once a stable casting situation has been established the transfer of the third aluminium alloy can be replaced by the lithium containing second alloy B which has been prepared in an induction melting furnace to obtain improved metal quality in accordance with the invention. In a further embodiment the cast length L1 is less than about three times the thickness T of the cast ingot, preferably L1 is less than about 2.5 times the thickness T of the ingot, and more preferably L1 is less than about two times the thickness T of the ingot.

In an embodiment prior to transferring the molten second aluminium alloy (with optional further alloying elements) to a casting station, the molten alloy is subjected to a melt treatment, preferably by means of a melt treatment comprising degassing of the molten aluminium alloy reducing the hydrogen content and particulate removal from the molten aluminium alloy. The gas may be introduced with either a spinning nozzle degasser, lance or flux wand. The degassing operation can be carried out in the induction furnace. Alternatively, or in addition thereto, the metal conveying trough is provided with a container for a metal degassing unit using a gas in particular for in-line reducing the hydrogen content and particulate removal from the molten aluminium alloy.

In an embodiment the metal conveying trough for the metal transfer from the induction furnace to the casting station is provided with at least one housing for a metal filter, preferably a ceramic foam filter, for in-line melt treatment for the removal of non-metallic inclusions.

In an embodiment the addition of lithium to the molten first aluminium alloy to obtain a molten second aluminium alloy having a purposive amount of lithium in the induction melting furnace is performed under a protective gas atmosphere, for example using an inert gas like helium or argon, but argon is most preferred. More preferably the protective gas atmosphere has been dried in advance, as is known in the art. This further avoids the entrapment of undesirable gas, hydrogen, nitrogen and oxygen in particular, or formation of oxides in the molten aluminium.

In an embodiment a reduced gas pressure can be maintained above the molten aluminium in the induction melting furnace. However, there is no desire to try to maintain any kind of vacuum in the induction melting furnace.

In an embodiment the addition of lithium into the molten first aluminium alloy to obtain a molten second aluminium alloy having a purposive amount of lithium is performed under a protective salt cover. Optionally in combination with an protective gas atmosphere. Preferably the salt mixture cover includes LiCl, and preferred salt mixtures include LiCl in combination with other salts selected from KCl, NaCl, and LiF. Sodium chloride is less preferred in the melting vessel since the sodium component thereof has a tendency to exchange with the lithium in the aluminium alloy, thereby adversely affecting the alloy content with sodium as a highly undesirable impurity element therein. Also KCl is less preferred.

In a preferred embodiment during step (c) the lithium is added in liquid form to the molten aluminium alloy, either as pure molten lithium or as a master-alloy. The molten lithium can be supplied from a neighbouring vessel or furnace containing the molten lithium metal. The molten lithium is transferred in controlled quantities from said neighbouring vessel through a fill pipe into the aluminium alloy present in the induction melting furnace. The end of the fill pipe can be provided with a disperser or diffuser. In combination with the induction melting furnace the molten lithium is easily and fast dispensed in the molten aluminium without unnecessary creation of oxides or gas entrapment. As well known to the skilled person, due to the operation of the inductors in an induction melting furnace the molten metal has currents going upwards from the bottom to near the surface and downwards from the surface to near the bottom of the furnace. In a preferred embodiment the molten lithium is introduced in the molten aluminium through a fill pipe in a downward current to facilitate the rapid mixing with the aluminium alloy and thus create a good homogeneity of the aluminium alloy.

In an embodiment during step (c) the lithium is added in solid form to the molten aluminium alloy, either as pure metal or in the form of a master-alloy.

In an embodiment the molten first aluminium alloy has a composition A comprising less than 0.1% of lithium, preferably less than 0.02%, and more preferably is substantially lithium free. The term "substantially free" means having no significant amount of that component purposely added to the alloy composition, it being understood that trace amounts of incidental elements and/or impurities may find their way into the aluminium alloy.

The method according to this invention is useful for lithium containing aluminium alloys having a Li-content in the range of at least about 0.2% Li, and preferably at least about 0.6%, and which may contain up to about 10% of Li, and preferably up to about 4%. In particular alloys of the 2XXX, 5XXX, 7XXX, and 8XXX-series families, such as, but not limited to, AA2050, AA2055, AA2060, AA2065, AA2076, AA2090, AA2091, AA2094, AA2095, AA2195, AA2196, AA2097, AA2197, AA2297, AA2397, AA2098, AA2198, AA2099, AA2199, AA8024, AA8090, AA8091, AA8093, and modifications thereof, can be produced.

The invention is not limited to the embodiments described before, which may be varied widely within the scope of the invention as defined by the appending claims.

The invention claimed is:

1. A method of producing molten aluminium-lithium alloys for casting a feedstock in the form of an ingot, the method comprising the steps of:

(a) preparing a molten first aluminium alloy with a composition A which is free from lithium as purposive alloying element, (b) transferring the molten first aluminium alloy to an induction melting furnace, (c) adding lithium as a master alloy under a protective gas atmosphere to the molten first aluminium alloy in the induction melting furnace to obtain a molten second aluminium alloy with a composition B having lithium as purposive alloying element, (d) optionally adding further alloying elements under the protective gas atmosphere to the molten second aluminium alloy, (e) transferring the molten second aluminium alloy with optional further alloying elements, if any, via a metal conveying trough from the induction melting furnace to a casting station without creating any turbulence in the molten second aluminium alloy with optional further alloying elements, if any.

2. The method according to claim 1, further comprising the step of initiating the start of casting the ingot and casting the second aluminium alloy with optional further alloying elements, if any, to a required length L1 of the ingot in the casting direction.

3. The method according to claim 1, the method further comprising the steps of:

(i) preparing at least two molten aluminium based alloys in separate furnaces; a third aluminium alloy with a composition C which is free from lithium as purposive alloying element prepared in a second furnace, and in the induction melting furnace the second aluminium alloy with the composition B which comprises lithium as purposive alloying element and with optional further alloying elements, if any, in accordance with steps (a) to (e);

(ii) transferring the third aluminium alloy via a metal conveying trough from the second furnace to the casting station;

(iii) initiating the start of casting an ingot and casting the third aluminium alloy to a required length L1 of an ingot in the casting direction;

(iv) subsequently transferring the second aluminium alloy via a metal conveying trough from the induction melting furnace to the casting station while simultaneously stopping the transfer of the third aluminium alloy to said casting station;

(v) casting the second aluminium alloy from an end surface of the cast third aluminium alloy at length L1 to an additional required length L2 in the casting direction;

(vi) cropping the cast ingot at a bottom thereof at a length that is greater than or equal to the cast length L1.

4. The method according to claim 2, wherein said casting comprises direct chill casting in a vertical direction.

5. The method according to claim 1, wherein prior to step (e) the molten second aluminium alloy with optional further alloying elements, if any, has been subjected to a melt treatment.

6. The method according to claim 1, wherein steps (c) and (d) are carried out under a protective salt layer in combination with the protective gas atmosphere.

7. The method according to claim 1, wherein during step (c) the lithium master alloy is added in a liquid form or a solid form.

8. The method according to claim 1, wherein the molten first aluminium alloy has a composition A comprising less than 0.1% of lithium.

9. The method according to claim 1, wherein the molten second aluminium alloy has a composition B comprising 0.2% to 10% of lithium.

10. The method according to claim 1, wherein prior to step (e) the molten second aluminium alloy with optional further alloying elements, if any, has been subjected to a melt treatment comprising degassing of the molten second aluminium alloy.

11. The method according to claim 1, wherein the molten second aluminium alloy has a composition B comprising 0.2% to 4% of lithium.

12. The method of claim 1, wherein in step (b), the molten first aluminium alloy is transferred to the induction melting furnace without creating any turbulence in the molten first aluminium alloy.

13. The method according to claim 1, wherein steps (a), (c) and (d) are carried out without a protective salt layer.

14. A method of producing molten aluminium-lithium alloys for casting a feedstock in the form of an ingot, the method comprising the steps of:

(a) preparing a molten first aluminium alloy with a composition A which is free from lithium as purposive alloying element, (b) transferring the first aluminium alloy to an induction melting furnace, (c) adding lithium to the first aluminium alloy in the induction melting furnace to obtain a molten second aluminium alloy with a composition B having lithium as purposive alloying element, (d) optionally adding further alloying elements to the second aluminium alloy, (e) transferring the second aluminium alloy with optional further alloying elements, if any, via a metal conveying trough from the induction melting furnace to a casting station, (i) preparing at least two molten aluminium based alloys in separate furnaces: a third aluminium alloy with a composition C which is free from lithium as purposive alloying element prepared in a second furnace, and in the induction melting furnace the second aluminium alloy with a composition B which comprises lithium as purposive alloying element and with optional further alloying elements, if any, in accordance with steps (a) to (e);

(ii) transferring the third aluminium alloy via a metal conveying trough from the second furnace to the casting station;

(iii) initiating the start of casting an ingot and casting the third alloy to a required length L1 of an ingot in the casting direction;

(iv) subsequently transferring the second aluminium alloy via a metal conveying trough from the induction melting furnace to the casting station while simultaneously stopping the transfer of the third aluminium alloy to said casting station;

(v) casting the second aluminium alloy from an end surface of the cast third aluminium alloy at length L1 to an additional required length L2 in the casting direction;

(vi) cropping the cast ingot at a bottom thereof at a length that is greater than or equal to the cast length L1.

* * * * *